US008339060B2

(12) United States Patent
Siessegger et al.

(10) Patent No.: US 8,339,060 B2
(45) Date of Patent: Dec. 25, 2012

(54) IGNITION TRANSFORMER FOR A DISCHARGE LAMP

(75) Inventors: Bernhard Siessegger, Munich (DE); Manfred Roehl, Bruckmuehl (DE)

(73) Assignee: Osram AG, Munich (DE)

( * ) Notice: Subject to any disclaimer, the term of this patent is extended or adjusted under 35 U.S.C. 154(b) by 407 days.

(21) Appl. No.: 12/524,188

(22) PCT Filed: Feb. 8, 2008

(86) PCT No.: PCT/EP2008/051546

§ 371 (c)(1),
(2), (4) Date: Jul. 23, 2009

(87) PCT Pub. No.: WO2008/098881

PCT Pub. Date: Aug. 21, 2008

(65) Prior Publication Data

US 2010/0045199 A1 Feb. 25, 2010

(30) Foreign Application Priority Data

Feb. 13, 2007 (DE) ..... 10 2007 007 128
Apr. 12, 2007 (DE) ..... 10 2007 017 338

(51) Int. Cl.
*H05B 41/16* (2006.01)
*H01F 27/02* (2006.01)

(52) U.S. Cl. ..... 315/276; 315/274; 315/289; 315/58; 336/83; 336/213; 336/212

(58) Field of Classification Search ..... 315/274–279, 315/209 CD, 213, 209 R, 219, 223–225; 336/212, 220, 90, 83, 324, 221
See application file for complete search history.

(56) References Cited

U.S. PATENT DOCUMENTS

| | | | | |
|---|---|---|---|---|
| 4,832,763 | A * | 5/1989 | Rauch et al. | 148/121 |
| 5,896,013 | A * | 4/1999 | Leskovec | 315/171 |
| 6,194,834 | B1 | 2/2001 | Seiler et al. | |
| 6,434,025 | B2 | 8/2002 | Shirai et al. | |
| 6,479,948 | B2 | 11/2002 | Yamamoto et al. | |
| 6,507,262 | B1 * | 1/2003 | Otte et al. | 336/213 |
| 6,611,191 | B2 * | 8/2003 | Nishimizu et al. | 336/212 |
| 7,221,103 | B2 * | 5/2007 | Siessegger | 315/274 |
| 2001/0026132 | A1 | 10/2001 | Yamamoto et al. | |
| 2005/0104703 | A1 * | 5/2005 | Watanabe et al. | 336/83 |
| 2006/0164023 | A1 * | 7/2006 | Siessegger | 315/274 |
| 2008/0258629 | A1 * | 10/2008 | Akashi et al. | 315/112 |
| 2009/0085492 | A1 * | 4/2009 | Siessegger | 315/209 R |
| 2009/0091259 | A1 * | 4/2009 | Kloss et al. | 313/567 |
| 2010/0045199 | A1 | 2/2010 | Siessegger et al. | |

FOREIGN PATENT DOCUMENTS

DE 19610385 A1 9/1997

(Continued)

OTHER PUBLICATIONS

English language abstract for JP 02216796 A, Aug. 29, 1990.
English language abstract for JP 2005340060 A, Dec. 8, 2005.
International Search Report of PCT/EP2008/051546 mailed Jun. 24, 2008.

(Continued)

*Primary Examiner* — Vibol Tan

(57) ABSTRACT

An ignition transformer for a discharge lamp is provided having a transformer core whose material and dimensions are selected in such a manner that the Curie temperature of the material after the ignition which is achieved by means of the ignition transformer can be achieved by a voltage drop across a secondary winding of the ignition transformer.

3 Claims, 5 Drawing Sheets

FOREIGN PATENT DOCUMENTS

| | | | |
|---|---|---|---|
| JP | 02216796 | A | 8/1990 |
| JP | 3297096 | A | 12/1991 |
| JP | 869931 | A | 3/1996 |
| JP | 8069930 | A | 3/1996 |
| JP | 8298190 | A | 11/1996 |
| JP | 10302988 | A | 11/1998 |
| JP | 11185982 | A | 7/1999 |
| JP | 2000286082 | A | 10/2000 |
| JP | 200145748 | A | 2/2001 |
| JP | 200293234 | A | 3/2002 |
| JP | 2004063550 | A | 2/2004 |
| JP | 2005340060 | A | 12/2005 |
| JP | 2010518650 | A | 5/2010 |
| WO | 2005011338 | A1 | 2/2005 |

OTHER PUBLICATIONS

English abstract of JP 10302988 A, Nov. 13, 1998.
English abstract of JP 2004063550 A, Feb. 26, 2004.
English abstract of JP 8069930 A, Mar. 12, 1996
English Abstract of JP 2000286082 A.
English Abstract of JP 3297096 A.
English Abstract of JP 869931 A.
English Abstract of JP 8298190 A.
English Abstract of JP 11185982 A.
English Abstract of JP 200293234 A.

* cited by examiner

IGNITION TRANSFORMER FOR A DISCHARGE LAMP

TECHNICAL FIELD

The invention relates to an ignition transformer for ignition of a discharge lamp, preferably a high-pressure gas discharge lamp, by means of pulse ignition, with the lamp being operated at high frequency from an electronic ballast after ignition.

BACKGROUND

A circuit arrangement which is reproduced in the document WO2005/011338 for a high-pressure discharge lamp has an operating part with a DC voltage source and an ignition part with a pulse source and a mercury-free halogen metal-vapor high-pressure discharge lamp. The discharge lamp and a secondary winding of an ignition transformer are connected in series in the ignition part. The primary winding of the ignition transformer is driven via a pulse source. A particularly low-loss material is preferred as the material for the ignition transformer core. After the discharge lamp has been ignited via the pulse source and the ignition transformer, the secondary winding is connected in series with the discharge lamp in the operating circuit.

Since the lamp current flows through the secondary winding during operation of the discharge lamp, this secondary winding has an undesirable inductance during lamp operation. Partial compensation for the inductance of the secondary winding can be achieved, according to the document cited above, in that a capacitor is connected in series with the secondary winding.

However, even when using the capacitor mentioned above, when the lamp is operated at high frequency, the inductance of the secondary winding still remains in the lamp circuit, thus resulting in losses both in the ignition transformer and in the transformer which produces the high-frequency lamp current.

SUMMARY

The object of the present invention is to provide an ignition transformer for a discharge lamp, in which the losses during high-frequency lamp operation are reduced and less circuitry complexity is required, and to provide a compact lamp cap.

This object is achieved by the ignition transformer for the discharge lamp as claimed in claims 1 and 2, and by a lamp cap as claimed in claim 3.

According to the invention, an ignition transformer is provided for a discharge lamp having a transformer core whose material, power and design are chosen in such a manner that the Curie temperature of the material after the ignition which is achieved by means of the ignition transformer can be achieved by a voltage drop across a secondary winding of the ignition transformer. The heating to the ignition temperature is achieved by means of the energy which is applied to the secondary winding, with the secondary winding of the ignition transformer being virtually ineffective after the Curie temperature has been reached, and with only a small amount of power and absorption being required from the lamp circuit, in order to keep the transformer core at the Curie temperature.

It is preferable for the material of the transformer core to have a Curie temperature in the range from 60° C. to 400° C., in particular between 100° C. and 220° C., thus preventing excessive heating of the transformer core, which could possibly have negative effects on materials in the vicinity of the transformer core.

It is preferable for the Curie temperature to be in the range between 100° C. and 220° C. since the efficiency decreases, as a result of heat losses, as the Curie temperature rises, while on the other hand the Curie temperature must in any case be above the ambient temperature, in order to make it possible to ensure correct operation.

Furthermore, the transformer core is preferably designed such that the magnetic length and the magnetically effective cross section of the transformer core are minimized in such a manner that magnetic coupling which is sufficient for ignition occurs between the primary and secondary winding in the cold state of the ignition transformer. This allows rapid ignition, while the secondary winding is at the same time virtually ineffective during lamp operation.

In one special refinement, the transformer core has an annular shape since, when the lamp is being operated at high frequency, less electromagnetic interference is caused than in the case of an open geometry such as a rod core.

Furthermore, it is preferable for the ignition transformer to be thermally insulated, in order to keep the transformer core at the Curie temperature with less power needing to be supplied and thus with higher efficiency of the arrangement as a whole, and to render the secondary winding virtually ineffective.

The transformer core is preferably encapsulated for thermal and electrical insulation, thus allowing the transformer core to be produced very economically.

Alternatively, the transformer core can be provided in a closed housing, thus suppressing the convection of air and the increased cooling associated with this.

The ignition transformer is intended in particular for a high-pressure discharge lamp. In this case, a compact physical form with a good light yield can be achieved particularly for motor vehicle headlights.

Furthermore, a lamp cap is provided for a discharge lamp having an ignition transformer with the characteristics described above, allowing the lamp arrangement to have a compact physical form, because of the small volume of the transformer core.

In one development, the discharge vessel of the lamp projects at least partially into the hole of the ignition transformer in the lamp cap. This allows the long axial size of the discharge lamps to be used to provide the transformer core in the vicinity of the discharge vessel of the discharge lamp.

BRIEF DESCRIPTION OF THE DRAWINGS

The invention will be explained in more detail in the following text with reference to exemplary embodiments. In the figures.

DETAILED DESCRIPTION

Figure 1:
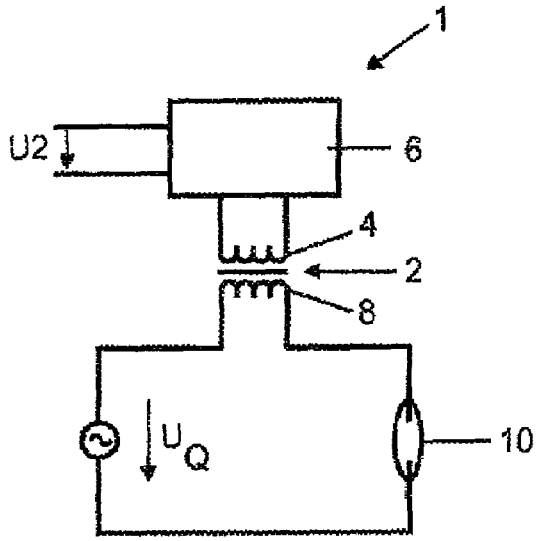
FIG. 1 shows a circuit arrangement for a discharge lamp having an ignition transformer according to the present invention.

A circuit arrangement 1 having an ignition transformer 2 corresponding to the present invention is illustrated in FIG. 1.

A primary winding 4 of the ignition transformer 2 is fed by a pulse source 6 and an ignition voltage U2. The secondary winding 8 of the ignition transformer 2 is connected in series with the discharge lamp 10, and is fed by an operating voltage $U_Q$. A high-pressure gas discharge lamp, for example a halogen metal-vapor lamp containing mercury of the "OSRAM HQI" type, is preferably used as the discharge lamp.

Figure 2:
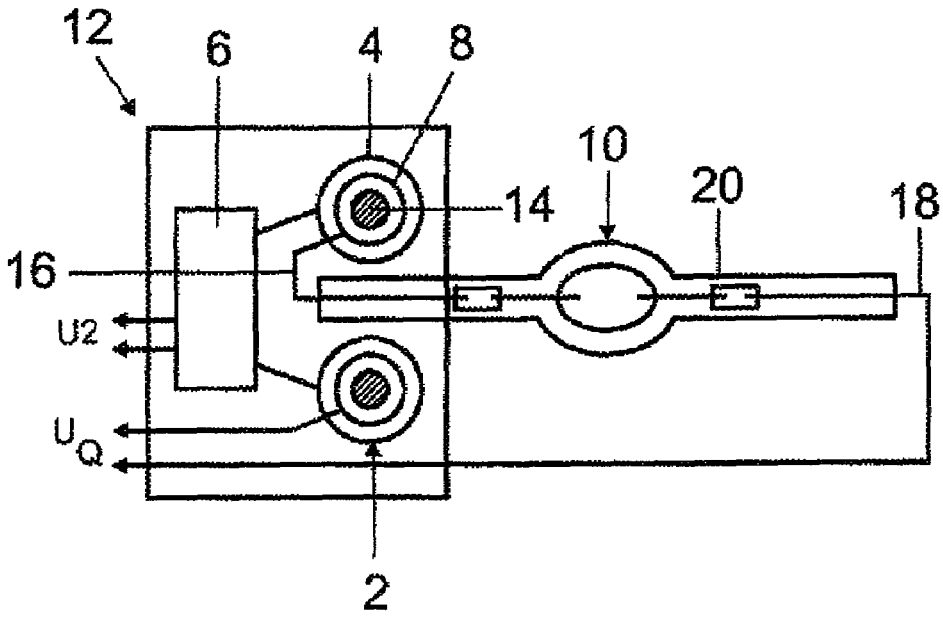
FIG. 2 shows a schematic view of a lamp cap having an ignition transformer, pulse source and discharge lamp, corresponding to the present invention.
Figure 3:
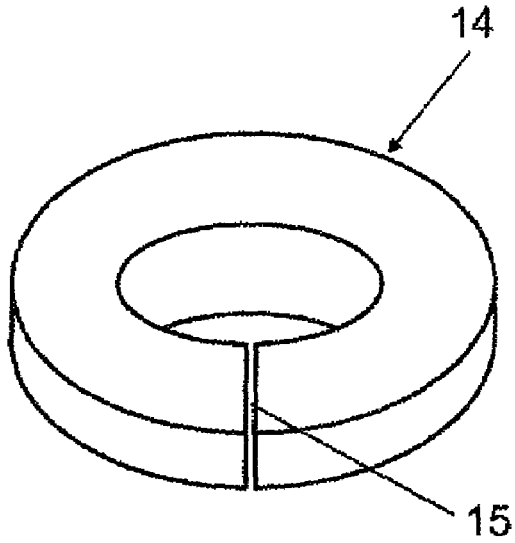
FIG. 3 shows a perspective view of a transformer core with a gap for an ignition transformer, corresponding to the present invention.

FIG. 2 illustrates a discharge lamp 10 in a lamp cap 12. The lamp cap 12 has the pulse source 6 which feeds the primary winding 4 of the ignition transformer 2. The ignition transformer 2 is preferably annular, as shown in FIG. 2, and has a transformer core 14 which has an air gap 15, as shown in FIG. 3. The secondary winding 8 is fitted on the transformer core 14, and is surrounded by the primary winding 4.

As already shown in FIG. 1, one connection 16 of the discharge lamp 10 is connected to one end of the secondary winding 8, while another connection 18 of the discharge lamp 10 is supplied with the operating voltage $U_Q$ via the lamp cap. As already shown in FIG. 1, the pulse source 6 is fed with the ignition voltage U2. The lamp cap 12 is preferably filled with an encapsulation compound, for example silicone, in order to provide good voltage insulation around the ignition transformer and thermal insulation of the transformer core 14, at the same time. Encapsulation can be carried out with a foam structure or a hollow-body filling. As an alternative to this, the core can be provided in a closed housing, by which convection of the air is prevented, thus suppressing cooling.

The connections for the ignition voltage U2 and the operating voltage $U_Q$ are passed out of the lamp cap as electrical connections to the appliance.

The discharge vessel 20 of the discharge lamp 10 projects into a central hole in the ignition transformer 2 as a result of which, as already described in laid-open specification DE 19610385, a small-volume gas discharge lamp can be provided, with short voltage supplies, and in integrated form. In addition to the advantageous compact design, losses in the ignition voltage can be kept low, because of this compact design.

FIG. 3 shows an example of a perspective view of the transformer core 14 with an air gap 15.

A ferrite is used as the core material. In this example, N30 from the manufacturer Epcos and with an external diameter of 25 mm, an internal diameter of 15 mm, a height of 3.8 mm and an air gap of 3.5 mm is used as the material. The material for the transformer core is chosen in such a manner that the Curie temperature is reached directly after ignition, by using a proportion of the energy provided by the transformer to heat the transformer core. When at least part of the transformer core has reached the Curie temperature, the secondary winding of the transformer is essentially ineffective, although a small amount of power absorption is required from the lamp circuit, in order to keep the transformer core or parts of the transformer core at the Curie temperature.

In the prior art, a high Curie temperature was desirable in order to allow the magnetic component to be operated at high power. In contrast to this, in the case of the present invention, a material with a Curie temperature which is preferably in the range between 60° C. and 400° C. is preferably desirable, since this material, owing to poor ferrite characteristics in terms of the prior art, results in the desired effect being achieved even at an early time in the secondary winding.

While a large transformer core cross section was advantageous because of the desirability of low losses in the prior art, a particularly small core cross section is desirable in the case of the present invention. Furthermore, the magnetic length should also be kept short. The energy which is required to heat the transformer core can thus be kept low. In summary, it can therefore be stated that a small core volume is advantageous for the present invention. However, the transformer core may be chosen to be sufficiently large that the transformer can carry out its functions, that is to say it allows adequate magnetic coupling between the primary winding and the secondary winding when in the cold state.

The annular shape shown in FIG. 3 is particularly suitable as a core shape, since less electromagnetic interference is caused at a temperature such as this and with high-frequency lamp currents than in the case of a rod core, with this interference occurring in particular at temperatures close to or at the Curie temperature.

Figure 4:
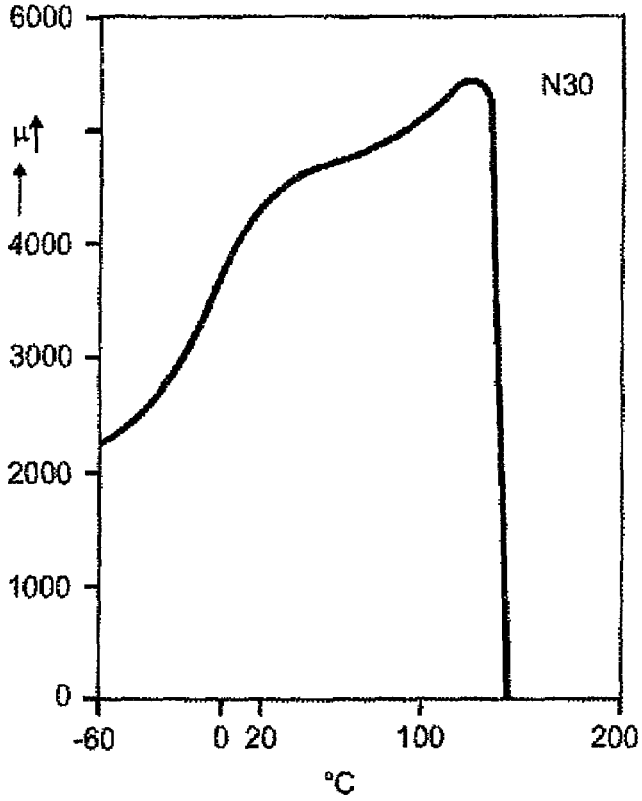
FIG. 4 shows an illustration in the form of a graph of the relationship between the initial permeability and the temperature, for one material for the transformer core, corresponding to the present invention.

As can be seen from FIG. 4, the permeability reaches the value of approximately unity from a temperature of approximately 143° C., the Curie temperature, when the core material used is N30. If the temperature of the transformer core is now kept close to 143° C. or somewhat above this temperature during operation after ignition, then the transformer core loses its ferromagnetic characteristics, and now exhibits only paramagnetic characteristics, as a result of which the secondary winding is virtually ineffective.

A transformer core composed of N30 material as described above is used in the first and second exemplary embodiments, which are described in the following text.

Figure 5:
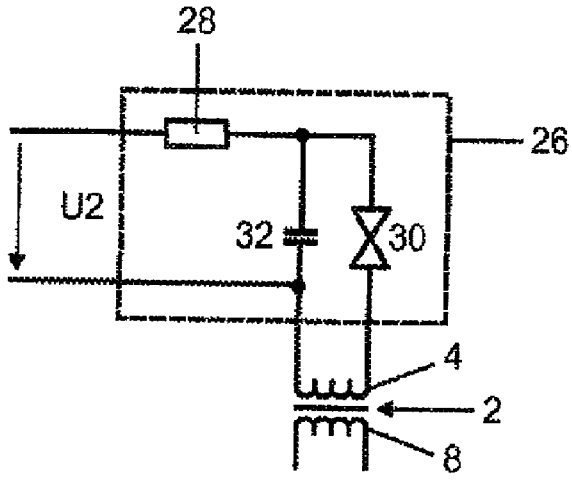
FIG. 5 shows the design of the pulse source for driving an ignition transformer, corresponding to the first exemplary embodiment of the invention.

FIG. 5 shows a pulse source 26 corresponding to the first exemplary embodiment, which is used instead of the pulse source 6 from FIG. 1.

The secondary winding 8 has 30 turns composed of Teflon-insulated wire, and has an impedance of 39 μH at 20° C. The primary winding has two turns. The middle turns of both the primary winding 4 and of the secondary winding 8 are arranged on the transformer core 14, opposite the air gap. The transformer core is insulated against heat and high voltage by vacuum encapsulation by means of silicone. The primary winding 4 is connected in series with a switching voltage of 2 kV via a resistor 28 of 100 kΩ and a spark gap 30. A capacitor 32 of 27 nF is connected in parallel with the ignition voltage U2, via the resistor 28. The ignition voltage U2 is 2.5 kV.

The operation of an ignition transformer with a pulse source 26 from FIG. 5 will be described in the following text.

As long as an ignition voltage U2 is present, the ignition transformer 2 produces pulses with a peak voltage of 21 kV on the secondary winding 8. This leads to ignition of the discharge lamp 10, which is not illustrated in FIG. 5. A halogen metal-vapor lamp containing mercury of the "OSRAM HQI" type and with a rating of 35 W is used as the discharge lamp.

Once the discharge lamp 10 has been ignited, the ignition voltage U2 is switched off as a result of which no further ignition pulses are produced via the ignition transformer 2. As shown in FIG. 1, the discharge lamp 10 is operated via the operating voltage $U_Q$ at a frequency of 2 MHz. The discharge lamp 10 is operated with an operating current of 400 mA, as a result of which a resistive-inductive voltage drop first of all occurs across the secondary winding 8, of about 200 V. This voltage drop results in heating of the transformer core 14. Initially, the lamp voltage is 20 V.

When the temperature of the transformer core 14 comes into the vicinity of the Curie temperature of about 143° C., then the inductance is drastically reduced, as shown in FIG. 4, as a result of which the voltage drop across the secondary winding is about 40 V. As a result of suitable thermal insulation and appropriate design of the circuit, the core temperature reaches a value close to the Curie temperature in the same time period as that required for the lamp to start up. In practice, this time period may be from a few seconds to a few minutes. During this time, the lamp voltage increases from initially 20 V to 85 V. Because of the reduced voltage drop across the secondary winding 8, only a low operating voltage $U_Q$ is required.

The lamp power is now regulated by increasing the frequency, for example from 2.5 MHz to 3.5 MHz. This regulation of the lamp power and the stabilization of the discharge are carried out by means of the remaining residual inductance of the secondary winding 8. This remaining inductance depends on the inductance of the air-cored coil formed by the secondary winding 8, and the temperature conditions during steady-state operation. This residual inductance is preferably chosen such that the resultant impedance is in the region of ⅕ to five times the impedance of the discharge lamp. In the first exemplary embodiment, the residual inductance was 8 μH. In this case, the impedance of the discharge lamp is the quotient of both of the two root mean square values of the lamp voltage and current in the rated conditions.

Figure 6:
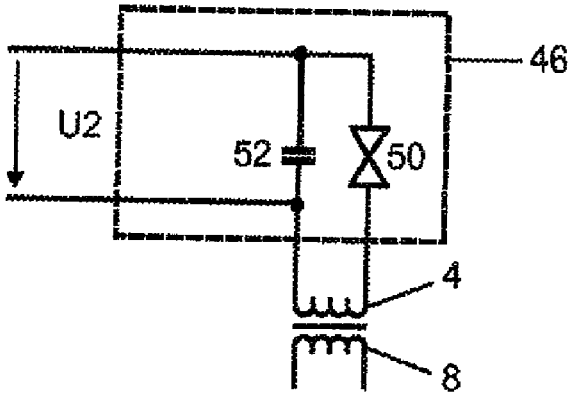
FIG. 6 shows the design of a pulse source for an ignition transformer, corresponding to the second exemplary embodiment of the invention.

FIG. 6 illustrates a pulse source 46 corresponding to the second exemplary embodiment. This pulse source 26 from the first exemplary embodiment has a spark gap 50 and a capacitor 52. No resistor that is comparable to the resistor 28 in the first exemplary embodiment is provided in the second exemplary embodiment. The capacitor 52 has a capacitance of 70 nF, and the spark gap has a switching voltage of 800 V.

Figure 7:
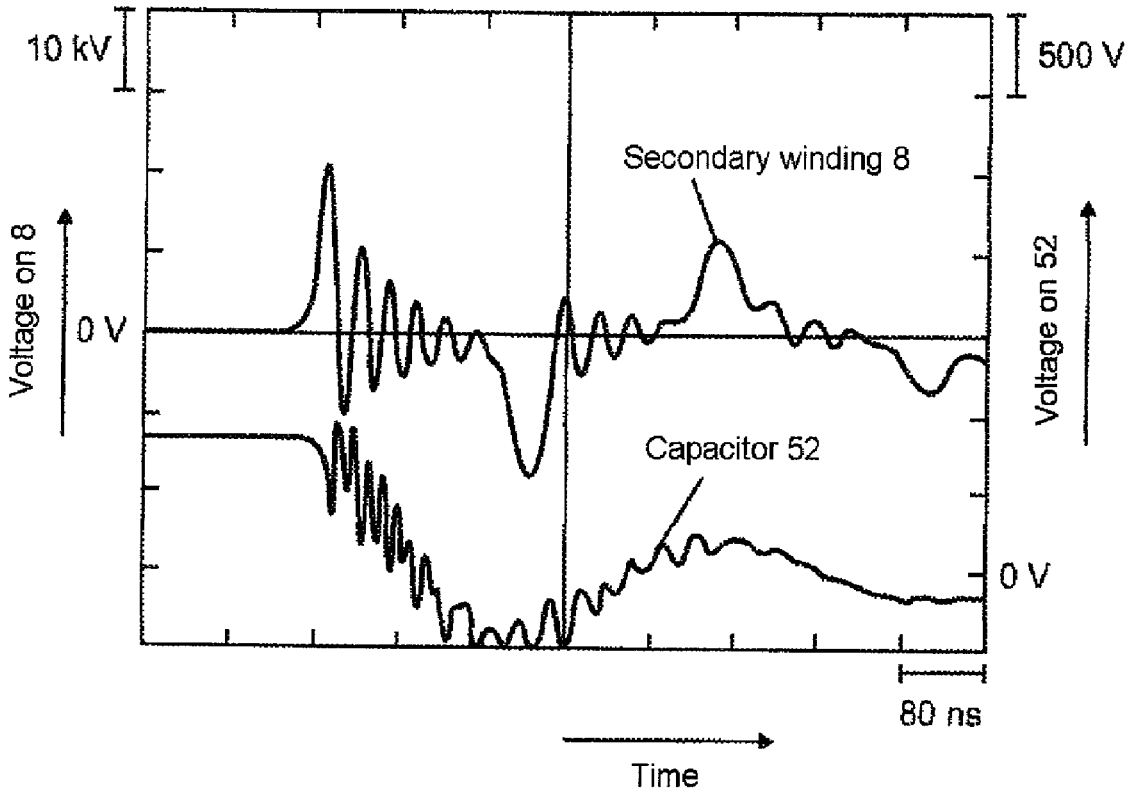
FIG. 7 shows an illustration, in the form of a graph, of the voltage on the secondary winding and on the capacitor, corresponding to the secondary exemplary embodiment.

The upper graph illustrated in FIG. 7 shows the voltage produced by the secondary winding 8, while the lower part of the illustration shows the voltage across the capacitor 52.

Following ignition, the lamp is then operated as in the circuit arrangement corresponding to the first exemplary embodiment. The circuit arrangement corresponding to the first and second exemplary embodiments makes it possible to operate a lamp after ignition with low inductance of the secondary winding as well as to achieve lower losses during operation of the discharge lamp.

The discharge lamps are preferably used for video projection, in motor-vehicle headlights and for general illumination. In comparison to the prior art disclosed in WO2005/011338, no additional components, for example the capacitor for partial compensation from this cited document, is required for a circuit arrangement for operation of a discharge lamp according to the present invention. The present invention therefore makes it possible to achieve good overall efficiency in the circuit arrangement.

Figure 8:
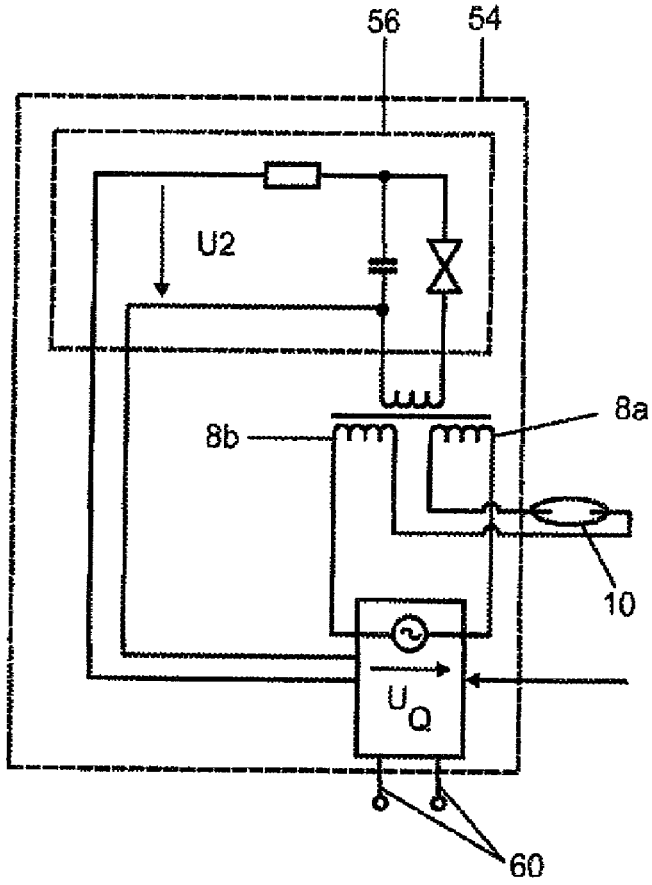
FIG. 8 shows a circuit arrangement for a discharge lamp using symmetrical ignition, corresponding to the third exemplary embodiment.

The embodiments described so far have always considered an asymmetric ignition arrangement in which the ignition transformer has only one secondary winding. FIG. 8 shows a circuit arrangement 54 according to the third exemplary embodiment, in which symmetrical ignition is achieved by the two secondary windings 8*a* and 8*b*. A ferrite with a Curie temperature of only about 109° C. and a maximum initial permeability of only 2500 is used as the core material, in contrast to approximately 143° C. and 5400 in the two previous exemplary embodiments, as shown in FIG. 4. Furthermore, FIG. 8 shows a pulse source 56 and an appliance 58 which provides the voltages U2 and $U_Q$. The connections for the power supply (for example 12 V direct current or 230 V alternating current) are annotated 60. The circuit arrangement 54 is located in the lamp cap.

Figure 9:
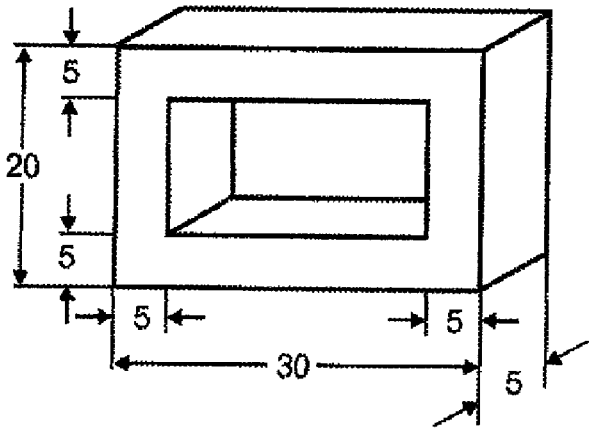
FIG. 9 shows a modification of a transformer core, with examples of dimensions.

The geometric dimensions of the core, which has no gap, are shown in FIG. 9. The two secondary windings 8*a* and 8*b* are in this case wound on the two 30 mm-long core sides. In a further process step, only half of the primary winding was in each case wound around the secondary windings 8*a*, and on the two long core sides.

The transformer is encapsulated together with the pulse source and the appliance in the lamp cap. In this case, parts of the appliance which become particularly hot during the operation, for example power semiconductors, are arranged in the immediate vicinity of the ignition transformer, in order to allow their waste heat to be used to heat the transformer core. A particularly small amount of energy therefore need be taken from the lamp circuit during operation in order to keep the transformer core close to the Curie temperature.

An ignition transformer for a discharger lamp is provided, having a transformer core. The material and the size of the transformer core are chosen in such a way that the Curie temperature of the material, after ignition achieved by means of the ignition transformer, can be achieved by a voltage drop across a secondary winding of the ignition transformer. This results in only residual inductance remaining for the secondary winding. A lamp cap is furthermore provided for a discharge lamp having an ignition transformer such as this, with the discharge vessel of the lamp preferably projecting at least partially into the center hole of the ignition transformer in the lamp cap, thus resulting in a compact lamp cap with a discharge lamp.

The invention claimed is:

1. An ignition transformer for a discharge lamp, the ignition transformer comprising:

a transformer core whose material and dimensions are selected in such a manner that the Curie temperature of the material can be achieved by means of a voltage drop across a secondary winding of the ignition transformer, after an ignition by the ignition transformer, wherein the magnetic length and the magnetically effective cross section of the transformer core is minimized in such a manner that magnetic coupling which is sufficient for ignition occurs between the primary and secondary winding in the cold state of the ignition transformer.

2. An ignition transformer for a discharge lamp, the ignition transformer comprising:

a transformer core whose material and dimensions are selected in such a manner that the Curie temperature of the material can be achieved by means of a voltage drop across a secondary winding of the ignition transformer, after an ignition by the ignition transformer, wherein the ignition transformer is thermally insulated, and wherein the transformer core is provided in a closed housing, by means of which convection of air is reduced.

3. A lamp cap for a discharge lamp having an ignition transformer, the ignition transformer comprising:

a transformer core whose material and dimensions are selected in such a manner that the Curie temperature of the material can be achieved by means of a voltage drop across a secondary winding of the ignition transformer, after an ignition by the ignition transformer, wherein a discharge vessel of the lamp projects at least partially into the center hole of the ignition transformer in the lamp cap.

* * * * *